US006190119B1

(12) United States Patent
Roth et al.

(10) Patent No.: US 6,190,119 B1
(45) Date of Patent: Feb. 20, 2001

(54) MULTI-CHANNEL REGENERATIVE PUMP

(75) Inventors: Peter P. Roth, Sherrard; Bruce C. Wright, Moline; Paul E. Roth, Lynn Center, all of IL (US)

(73) Assignee: Roy E. Roth Company, Rock Island, IL (US)

( * ) Notice: Under 35 U.S.C. 154(b), the term of this patent shall be extended for 0 days.

(21) Appl. No.: 09/363,514

(22) Filed: Jul. 29, 1999

(51) Int. Cl.[7] ..... F01D 1/12
(52) U.S. Cl. ..... 415/55.7; 415/196
(58) Field of Search ..... 415/55.1, 55.2, 415/55.3, 55.4, 55.5, 55.6, 55.7, 196, 203, 224

(56) References Cited

U.S. PATENT DOCUMENTS

| | | | | |
|---|---|---|---|---|
| Re. 19,101 | | 3/1934 | Burks . | |
| 1,686,549 | | 10/1928 | Burks . | |
| 1,689,579 | | 10/1928 | Burks . | |
| 1,861,837 | | 6/1932 | Burks . | |
| 1,871,209 | | 8/1932 | Burks . | |
| 2,875,698 | | 3/1959 | Roth . | |
| 3,963,371 | * | 6/1976 | Sieghartner | 415/199 |
| 4,178,131 | | 12/1979 | Sieghartner . | |
| 4,248,571 | | 2/1981 | Sieghartner . | |
| 4,299,536 | | 11/1981 | Sieghartner et al. . | |
| 4,479,756 | | 10/1984 | Sieghartner . | |
| 5,137,418 | | 8/1992 | Sieghartner . | |
| 5,238,253 | | 8/1993 | Sieghartner . | |
| 5,525,039 | * | 6/1996 | Sieghartner | 417/32 |
| 6,007,311 | * | 12/1999 | Cygnor et al. | 417/405 |
| 6,019,570 | * | 2/2000 | Talaski | 415/55.1 |

OTHER PUBLICATIONS

MTH Pumps, Series T41 Pricing Pages, dated Mar. 1992.

* cited by examiner

*Primary Examiner*—Edward K. Look
*Assistant Examiner*—James M. McAleenan
(74) *Attorney, Agent, or Firm*—Emrich & Dithmar

(57) ABSTRACT

A turbine impeller pump assembly includes a rotating shaft and inboard and outboard casing members coupled together with each having cavity channels, and an annular recess, and an axial opening to receive the rotating shaft. Inboard and outboard liner members are structurally arranged to be received by the annular recesses in the casing members and an impeller member is positioned between the liner members and keyed for rotation with the shaft. The inboard and outboard liner members each have at least two flow channels structurally arranged to cooperate with the cavity channels to provide equal and opposite pressures on the impeller to maintain the impeller in alignment with respect to the liner members.

13 Claims, 7 Drawing Sheets

MULTI-CHANNEL REGENERATIVE PUMP

BACKGROUND OF THE INVENTION

The present invention relates to a multi-channel flow through a turbine impeller pump assembly to cancel the radial pressure loads on the turbine impeller.

In the assembly of turbine impeller pumps, a turbine impeller, keyed to the rotating shaft, rotates within a plane perpendicular to the shaft within the confines of annular liners. As set forth in U.S. Pat. No. 5,137,418, assigned to the assignee of the present invention, the turbine impeller is axially movable with respect to the shaft, to be positioned between the annular liners. Also, such pump assemblies include a single channel flow through the annular liners to the impeller. However, this single channel flow does not compensate for the shaft radial loading caused by hydraulic forces that necessarily occurs within the pump assembly during pumping operations. Such forces cause the shaft and impeller to incur forces and moments and thus move off-center and rotate in an axial plane of the shaft centerline thereby causing interference between the rotating impeller and the stationary liners within the pump assembly unless clearance is provided. Clearance allowances for this deflection is a compromise between a design pressure limit and leakage. Increasing clearance allows more deflection without damage but leakage losses increase to the detriment of efficiency. Increasing leakage reduces the maximum capability. Such interferences caused by pressure above the designed value result in premature pump failures thereby resulting in costly and expensive repair to the pump assembly.

SUMMARY OF THE INVENTION

It is one object of the present invention to provide a turbine impeller pump assembly which cancels the radial hydraulic forces that create the moments in the axial plane of the shaft centerline.

It is another object of the present invention to provide a dual channel flow through a turbine impeller pump assembly to cancel the radial loads on the shaft bearings.

It is a further object of the present invention to provide a turbine impeller pump assembly which includes liners enclosing the impeller with each liner having separated flow channels mirrored about the Y-axis, to provide a multi-channel flow through the assembly.

It is still another object of the present invention to provide a turbine impeller assembly which includes suction and discharge ports opposite one another which cooperate with the multi-flow channels in the liner members to produce equal and offsetting pressures on the impeller to allow the impeller to be radially centered. Through the presence of the ramped surface configuration on the surface of the impeller or liner members, the impeller is caused to be axially centered between the outboard and inboard liner members.

It is yet another object of the present invention to provide a turbine impeller pump assembly having equal and opposite pressures on the impeller which eliminates shaft deflection within the pump assembly.

It is yet a further object of the present invention to provide a novel turbine impeller pump assembly which is practical and efficient in operation without shaft deflection and with substantially minimal radial load so that lower capacity bearings may be employed in the assembly.

The present invention is directed to a novel multi-channel flow path of the pumped fluid through a turbine impeller pump assembly which cancels the axial and radial pressure loads on the turbine impeller. A single stage turbine impeller pump assembly includes a motor driving a rotating shaft. The shaft extends through an inboard cover surrounding an inboard liner, an impeller is rotationally fixed to the shaft and an outboard liner is enclosed by an outboard cover. The covers support the liners embodying the channel and provide the fluid paths to and from the liner's inlets and outlets and the exterior of the pump.

The inboard and outboard liners enclose the impeller, which is radially fixed to the shaft to rotate. Each of the liners includes a flow channel mirrored about the Y-axis and which are separated from each other to provide two or dual channels that are separated from one another. The liners are enclosed by inboard and outboard cover or casing members. The inboard and outboard covers are the locations for the inlet and outlet port for the pump, which are mirrored about the X and Y axis and which make them opposite one another. However, it is within the scope of the present invention in that the inlet and outlet port may be positioned radially in the inboard and outboard cover members. The fluid entering the suction port is operatively diverted to the two suction ports on each liner whereby the fluid is then recirculated by the vanes on the impeller. The fluid is propelled around each channel of the liners and exits the two discharge ports in the liners. The discharged fluid is combined to exit through the discharge port of the pump.

The structure of positioning the suction and discharge ports opposite one another and the dual channels of the liners produces equal and opposite pressures on the rotating impeller to cancel the radial loads on the impeller and to facilitate the impeller to self-center itself between the liners. The equal and opposite pressure condition eliminates shaft deflection during pumping operations which results in substantially reduced wear on the impeller and liners and results in significantly lighter loads. The elimination of the vector resultant of the radial hydraulic loads, the subsequent cross-moments in the plane of the shaft centerline and subsequent shaft deflection significantly reduces bearing loads and the associated costs of replacement. This permits the use of sleeve bearings in the pump assembly which allows the use of the pumped fluid as the bearing lubricant when the pumped fluid is a non-lubricating fluid.

The present invention consists of certain novel features and structures details hereinafter fully described, illustrated in the accompanying drawings, and specifically pointed out in the appended claims, it being understood that various changes in the details may be made without departing from the spirit or sacrificing any of the advantages of the present invention.

DESCRIPTION OF THE DRAWINGS

The foregoing description and other characteristics, objects, features and advantages of the present invention will become more apparent upon consideration of the following detailed description, having references to the accompanying drawings wherein.

DESCRIPTION OF A PREFERRED EMBODIMENT

Figure 1:
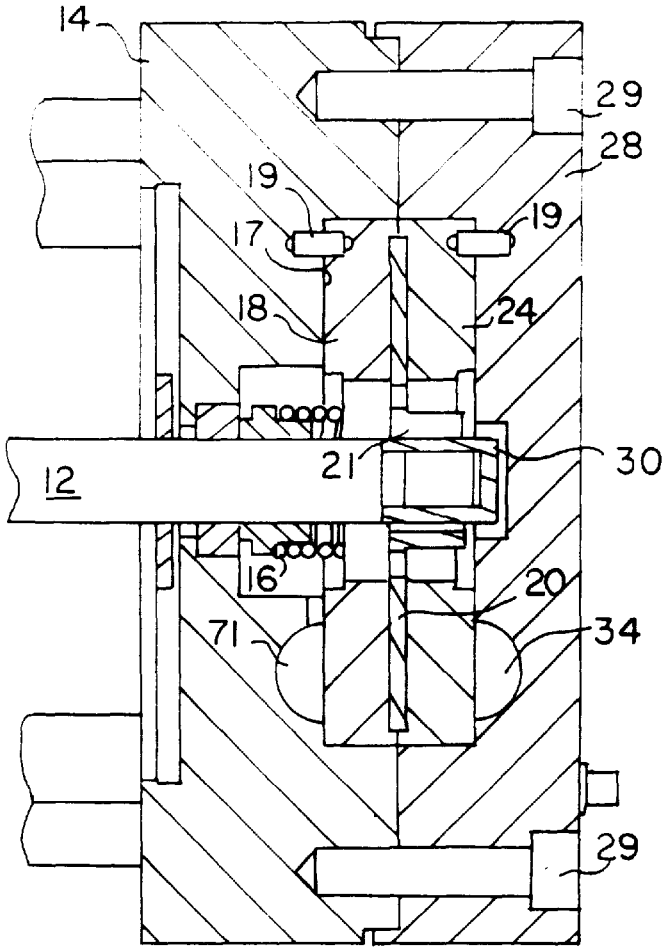
FIG. 1, is a cross-sectional view of a single stage turbine impeller pump in accordance with the present invention.

Referring now to the drawings wherein like numerals have been used throughout the several views to designate the same or similar parts, there is illustrated in FIG. 1 a simplified representation of a single-stage turbine impeller pump assembly in accordance with one embodiment of the present invention. The pump assembly (FIG. 1) includes a rotating shaft member 12 driven by a power source (not shown), such as an electric, gasoline, steam or fluid motor. The shaft 12 extends through the inboard cover or casing member 14 and associated seal assembly 16 which surrounds the shaft and permits rotation of the shaft with respect to the inboard cover member 14. An inboard liner member 18 is structurally arranged to be received by recess 17 in the casing 14 and is keyed to the cover 14 by pin member 19. The pin member aligns the inboard liner member 18 with respect to the inboard cover 14 to assist in providing the communications between the channel 71 and the inlet ports 36, 37 of liner 18 and 24, as will hereinafter be described.

Figure 12:
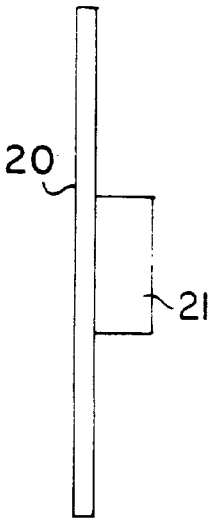
FIG. 12 is a side view of the impeller member illustrated in FIG. 11.
Figure 11:
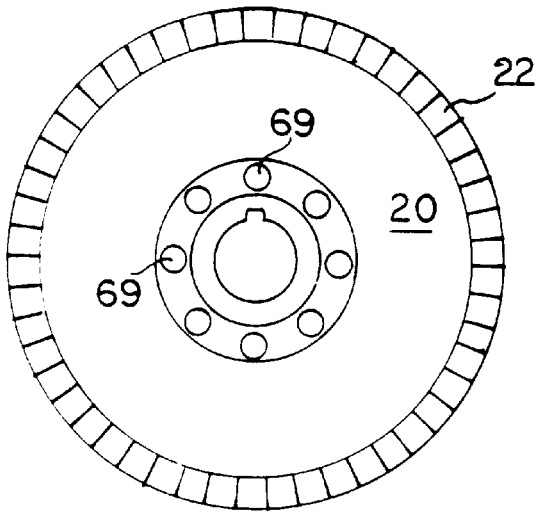
FIG. 11 is a front view of the impeller member which cooperates with the outboard and inboard liner members to provide equal and opposite pressures on the rotating impeller in accordance with the present invention.
Figure 14:
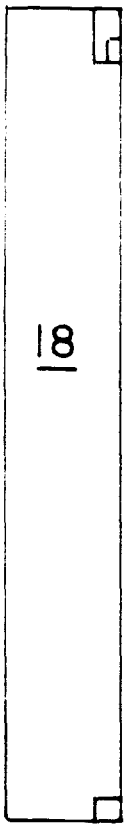
FIG. 14 is a side view of the inboard liner member illustrated in FIG. 13.

Mounted to the shaft for rotation thereby and adjacent to the inboard liner 18 is an impeller member 20. The impeller member 20 includes a hub portion 21 (FIGS. 1 and 12) sufficient to accept the driving contact pressures within acceptable stress limits and circumferential vanes 22, as shown in FIG. 11. Also, the impeller member 20 includes openings 69 therethrough which aid in self-centering of the impeller, as will hereinafter be described. Mounted adjacent to the impeller 20 is an outboard liner member 24 which is adapted to be received in recess 25 of the outboard cover or casing member 28. The outboard cover member 28 is attached to the inboard cover member 14 by bolt members 29 to define the pump cavity containing the liners 18 and 24. To contain the shaft 12 in a lateral position, there must be sufficient bearings to contain the shaft against transient lateral and axial loads. Various configurations are acceptable for accomplishing this purpose. That is, bearings may be outside with the shaft extending into the pump assembly and the pumped fluid. Alternatively, it is within the scope of the present invention that one or more of the bearings may be inside the assembly with the pumped fluid. Conventionally, one bearing is a ball bearing capable of containing axial thrust. If the bearings are of the sleeve type, a thrust bearing must be provided.

Figure 2:
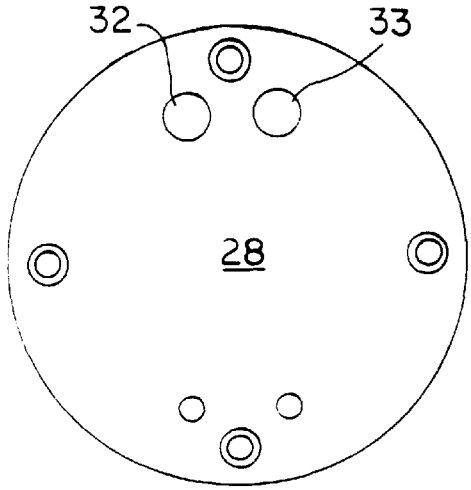
FIG. 2 is a frontal view of the outboard casing or cover member illustrating the suction and discharge ports in accordance with one embodiment of the present invention.
Figure 3:
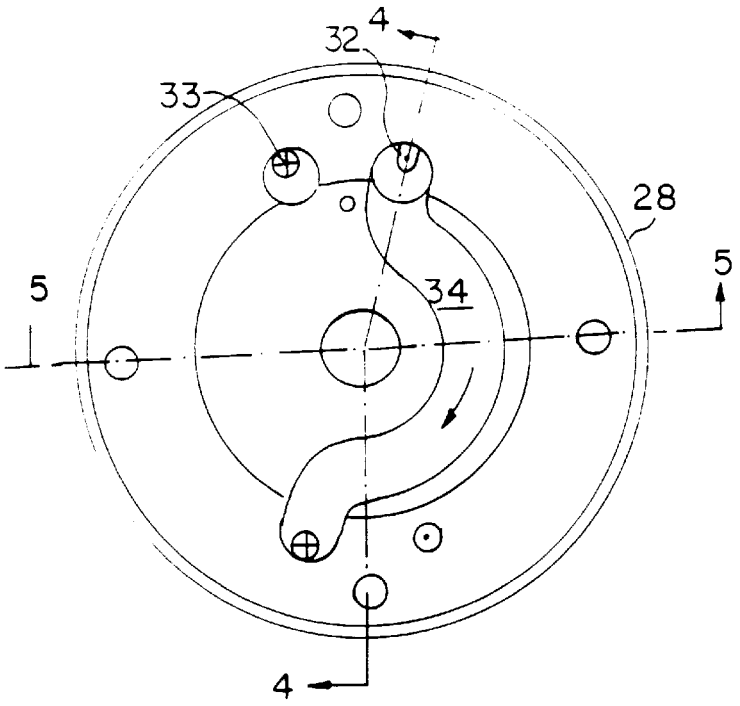
FIG. 3 is an axial side view of the inboard facing of the outboard casing or cover member illustrating the fluid flow through the casing in accordance with the present invention.
Figure 4:
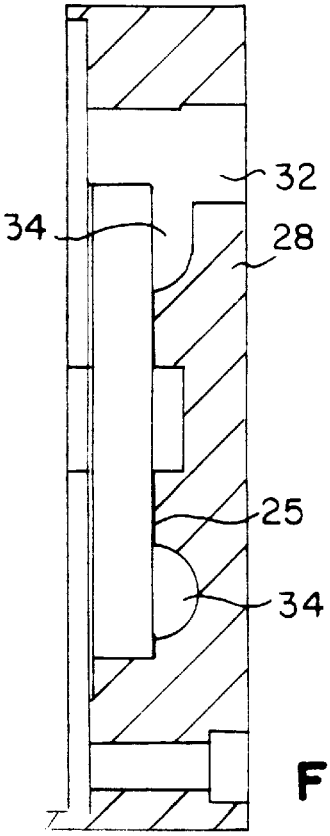
FIG. 4 is a section of FIG. 3 taken along lines 4—4.
Figure 5:
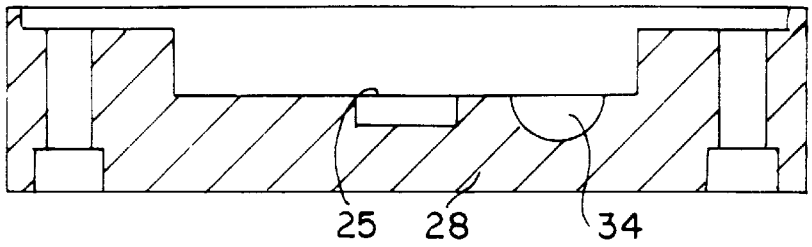
FIG. 5 is a section of FIG. 3 taken along lines 5—5.
Figure 7:
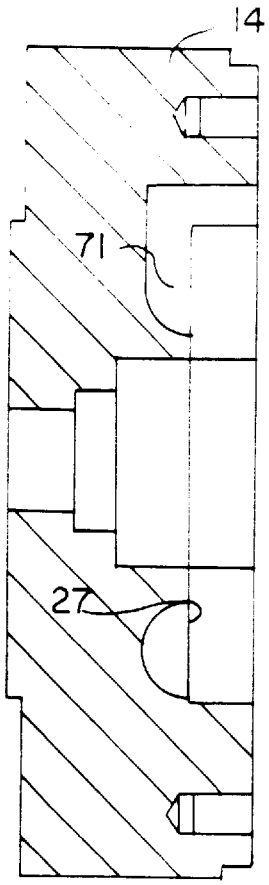
FIG. 7 is a section of FIG. 6 taken along lines 7—7.
Figure 6:
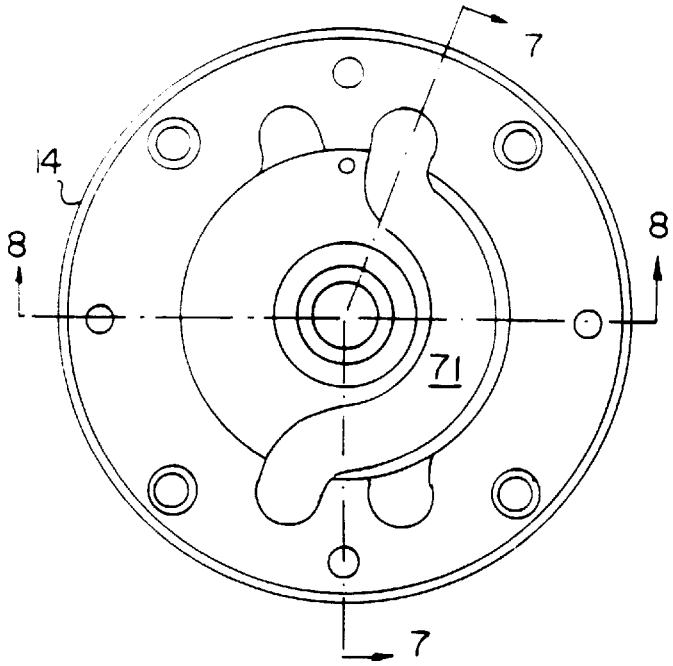
FIG. 6 is an axial side view of the outward facing of the inboard casing or cover member illustrating the fluid flow through the casing in accordance with the present invention.
Figure 8:
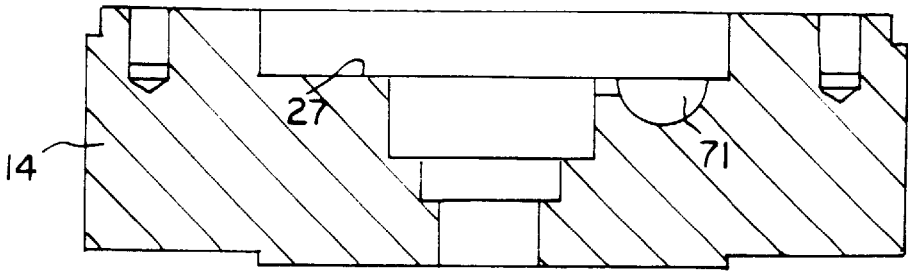
FIG. 8 is a section of FIG. 6 taken along lines 8—8.

One embodiment of the present invention is shown in FIGS. 2–9 and 13. When a dual flow configuration is desired in a single-stage turbine pump assembly, the outboard cover or casing member 28 includes a suction inlet port 32 and a discharge outlet port 33, as shown in FIG. 2. FIGS. 3–5 illustrate the flow of fluid into inlet port 32 and through the outboard cover member 28. Specifically, the fluid enters inlet port 32 and is directed through the outboard cavity channel 34 wherein the fluid is directed to the dual suction inlet ports 36 and 37 of liners 18 and 24 and outward through the outlet ports 40 and 41 located on liner members 18 and 24, as shown in FIGS. 9–10 and 13–14. FIGS. 4 and 5 are sections of the outboard cover or casing member 28 taken along lines 4—4 and 5—5 of FIG. 3 and illustrate the position of the cavity channels 34, which cooperate with the inlet ports 36, 37 on the outboard liners 18 and 24 to receive the fluid and to direct the fluid to the impeller member 20 and subsequently through to the outlet ports 40, 41.

Figure 15:
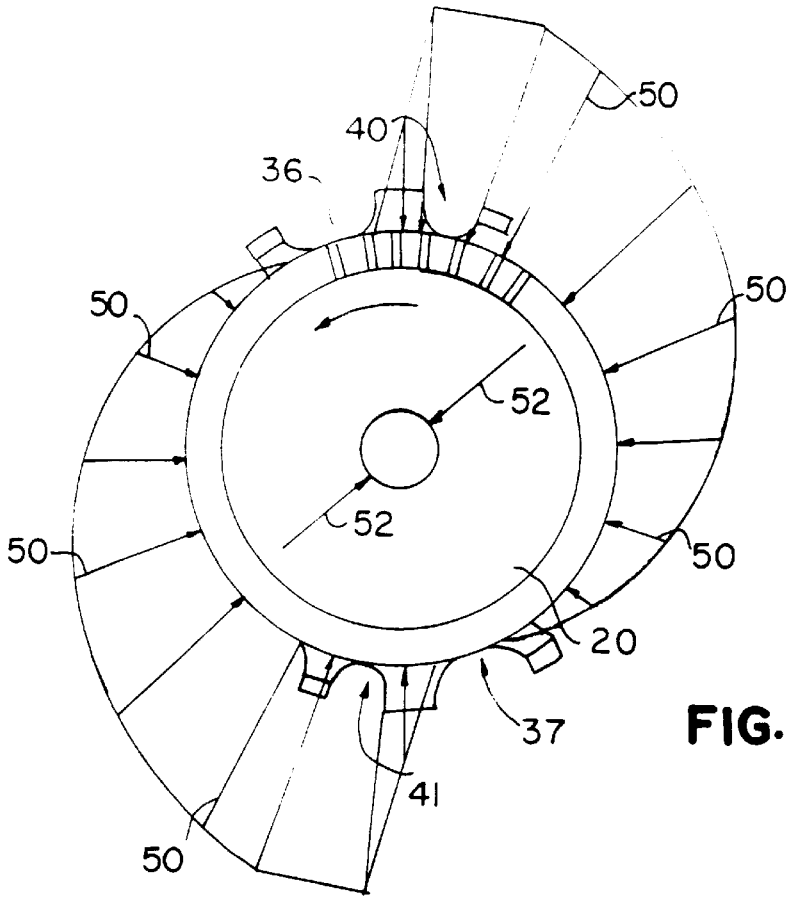
FIG. 15 is a schematic view illustrating the cancellation of the side load vectors and radial loads on the impeller resulting from a dual channel configuration in accordance with one embodiment of the present invention.

As shown in FIGS. 6–8 and 13–14, the inboard casing member 14 also includes a inboard cavity channel 71 which communicates with the outlet ports 40 and 41 in the liner members 18 and 24. The inboard liner member 18 is adapted and structurally arranged to be received within recess 27 of the inboard casing member 14. The pumped fluid is directed through outlet ports 40 and 41. As the fluid travels through liner channels from 36 to 41 and 37 to 40, pressure builds, as shown in FIG. 15. This provides equal and opposite pressures on the rotating impeller. Thus, each liner member has two channels 36 to 41 and 37 to 40 mirrored about the Y-axis and separated. These channels cooperate with the suction and discharge ports in the inboard and outboard casing members.

Figure 9:
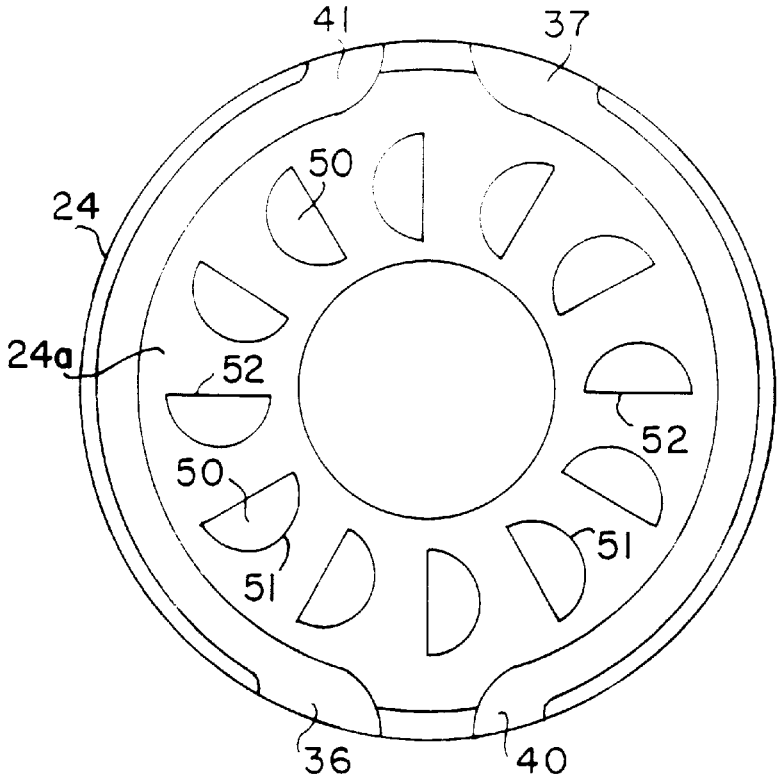
FIG. 9 is a front view of the outboard liner member which cooperates with the impeller member to provide the impeller member with balance pressures in accordance with the present invention.
Figure 10:
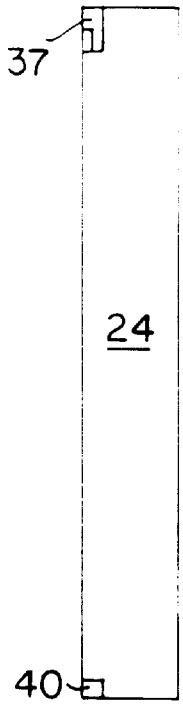
FIG. 10 is a side view of the outboard liner member illustrated in FIG. 9.
Figure 13:
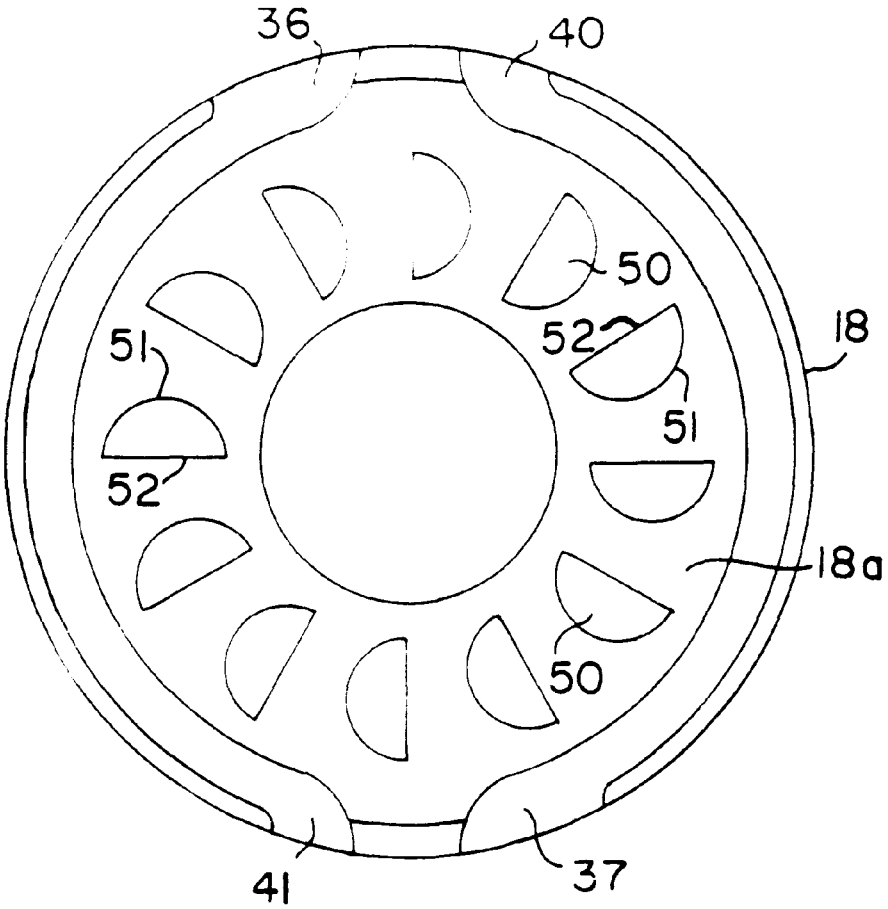
FIG. 13 is a front view of the inboard liner member which cooperates with the impeller member to provide equal and opposite pressures on the impeller member in accordance with the present invention.

As shown in FIGS. 9 and 13, the liner member side-wall surfaces 24*a* and 18*a*, respectively, preferably, include a plurality of ramped recesses 50 in a substantially symmetrical and balanced pattern thereon, with each of the recesses 50 having a leading edge 51 and trailing edge 52. These ramped recesses 50 provide a pressurized film of fluid between the rotating impeller and the liner member wall surfaces which acts as a fluid barrier to prevent wear on the liner member and impeller 20.

Thus, the fluid flow through the single stage impeller pump produces an equal and opposite axial and radial pressure on the rotating impeller to cause the impeller to center itself between the inboard and outboard liners and to cancel opposing steady state hydraulic forces on the impeller and, subsequently, the pump shaft.

In FIG. 15, the flow of pumped fluid through the inboard and outboard liners 18 and 24 to the rotating impeller 20 is illustrated to demonstrate the resultant magnitude and direction of the pressures on the rotating impeller. As is readily apparent, the magnitude and direction of the pressures 50 on the impeller 20 resulting from the fluid flow from the inlet 37 to the discharge or outlet 40 of the dual (two) channel configuration within the inboard liner member 18 increases from the inlet 37 to the discharge 40. Similarly, the pressures 50 on the impeller 20 resulting from the fluid flow from the inlet 36 to the outlet 41 increases from the inlet to the outlet. The resultant side load vectors 52 are 180 degrees from each other. Accordingly, the fluid flow through the inboard and outboard liners to the impeller produces an equal and opposite pressure on the rotating impeller to permit the impeller to self-center itself between the liner members and to cancel the opposing steady state hydraulic forces on the impeller member 20 and, ultimately, on the pump shaft 12. This structure eliminates shaft deflection and permits the use of lower capacity shaft bearing structures within the pumping assembly.

Figure 16:
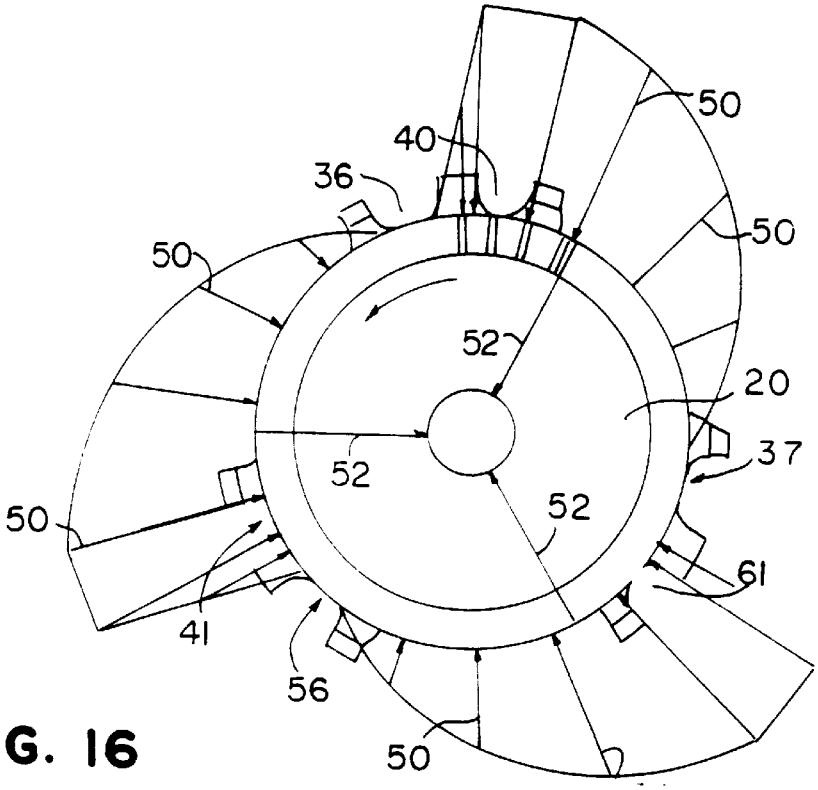
FIG. 16 is a schematic view illustrating the cancellation of the side load vectors and radial loads on the impeller resulting from a triple channel configuration in accordance with another embodiment of the present invention.

In FIG. 16, the flow of pumped fluid through the inboard and outboard liners 18 and 24 to the rotating impeller 20 is illustrated to demonstrate the resultant magnitude and direction of the pressures on the rotating impeller when more than two channels are utilized in accordance with the present invention. As is readily apparent, the magnitude and direction of the pressures 50 resulting from the fluid flow from the inlet 37 to the discharge 40 of a three channel configuration within the inboard liner member 18 increases from the inlet 37 to the discharge 40. Similarly, the pressures 50 on the impeller 20 resulting from the fluid flow from the respective inlets 36 and 56 to the respective outlets 41 and 61 increases from the inlet to the outlet. The resultant side load vectors 52 are 120 degrees from each other. Accordingly, the fluid flow through the inboard and outboard liners to the impeller produces a uniform inward pressure on the rotating impeller to cause the impeller to self-center itself between the liner members and to cancel the opposing steady state hydraulic forces on the impeller member 20 and, ultimately, on the shaft 12. Thus, it is important to the operation of the present invention that the resultant side load vectors must be uniformly, distributed about the impeller to cancel the steady state hydraulic forces on the impeller.

Figure 17:
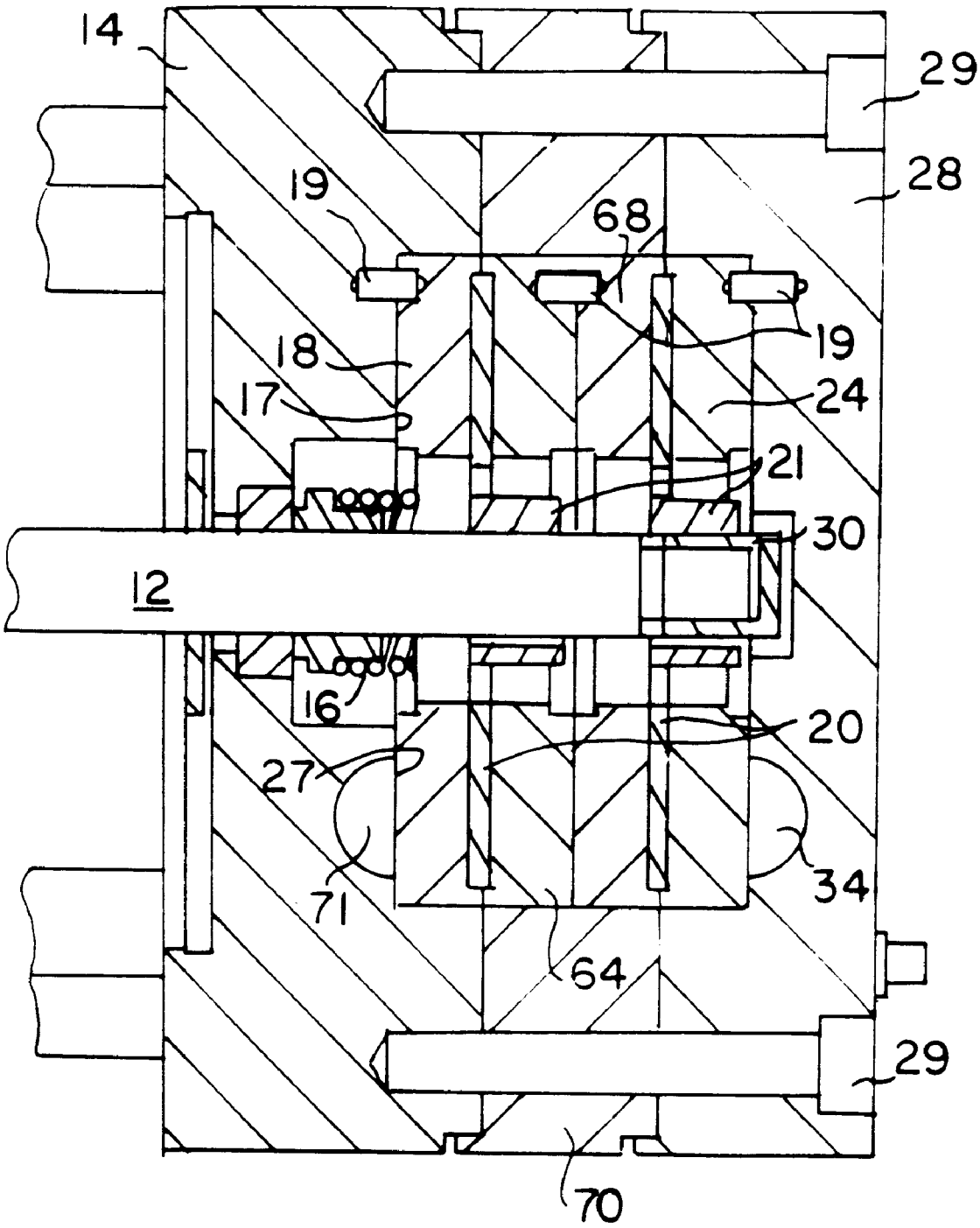
FIG. 17 is a cross-sectional view of a multi-stage turbine impeller pump in accordance with a further embodiment of the present invention.

As shown in FIG. 17, the present invention is of such a scope that a multi-stage turbine impeller pump assembly is shown as a further embodiment of the present invention. In FIG. 17, the pump assembly includes a rotating shaft member 12 driven by a power source (not shown), such as an electric, gasoline, steam or fluid motor. The shaft 12 extends through the inboard cover or casing member 14 and associated seal assembly 16 which surrounds the shaft and permits rotation of the shaft with respect to the inboard cover member 14. A first inboard liner member 18 is structurally arranged to be received by recess 27 in the casing 14 and is keyed to the cover member 14 by pin member 19. The pin member aligns the inboard liner member 18 with respect to the inboard cover 14 to align the inlets 36 and 37 with the inner and outer cover channels 34 and 71 and, thus, assist in providing the equal and opposite pressure upon the rotating impeller, as will hereinafter be described.

Mounted to the shaft for rotation thereby and adjacent to the inboard liner 18 a first impeller member 20. The impeller member 20 includes a hub portion 21 (FIGS. 1 and 12) sufficient to accept the driving contact pressures within acceptable stress limits and circumferential vanes 22. Mounted adjacent to the impeller 20 is a liner member 64 which is keyed to another liner member 68 adjacent to a second impeller member 20. The inlets of the second liner set are angularly aligned with the outlets of the preceding liners in the flow path. The liner members 64 and 68 are retained within the assembly by an annular spacer member 70. Mounted adjacent to the second impeller 20 is an outboard liner member 24 which is adapted to be received in recess 25 of the outboard cover or casing member 28. The spacer member 70 and the outboard cover member 28 are attached to the inboard cover member 14 by bolt members 29. Accordingly, FIG. 17 illustrates a multi-stage turbine pump assembly that may include a plurality of pumping stages.

The present invention has disclosed the cavity channels 34 and 71 as being located on or adjacent the surface of the liner members. However, it is within the scope of the present invention that the cavity channels may be located within the liner members or a location near or adjacent the outer surfaces of the liner members.

The multi-stage pump assembly (FIG. 17) in accordance with the present invention permits easy assembly, with fewer parts while insuring that the impeller is continuously centered with respect to the liners.

What is claimed is:

1. A single stage turbine impeller pump assembly, including in combination:

a rotatable shaft;

inboard and outboard casing members coupled together, each having cavity channels therein and each having a surface having an annular recess therein and an axial opening there through which permits said shaft to rotate therein;

inboard and outboard liner members structurally arranged to be received by the respective annular recesses in said casing members, with each of said liner members being fixed to a respective one of said casing members;

an impeller member positioned between said liner members and fixed for rotation with said shaft; and wherein said inboard and said outboard liner members each have at least two flow channels which are uniformly distributed therein and include an inlet and a discharge positioned at 180° or less from each other and which are structurally arranged to cooperate with said cavity channels in said inboard and said outboard casing members to provide equal and opposite pressures on said impeller member to maintain said impeller in alignment with respect to said liner members.

2. The single stage turbine impeller pump assembly in accordance with claim 1, wherein said inboard and said outboard liner members each have through flow channels associated therewith and structurally arranged to cooperate with said cavity channels.

3. The single stage turbine impeller pump assembly in accordance with claim 1, wherein each of said inboard and said outboard liner members have fixed sealing surfaces having a plurality of recesses thereon disposed in at least one annular and symmetrical pattern, with each of said recesses having a leading edge and a trailing edge to provide a pressurized film of fluid between said sealing surfaces and said rotating impeller.

4. The single stage turbine impeller pump assembly in accordance with claim 1, wherein said outboard casing member includes a suction inlet port in the surface of said casing member opposite said surface having said annular recess therein, which port cooperates with said cavity channels therein.

5. The single stage turbine impeller pump assembly in accordance with claim 2, wherein said cavity channels of said outboard casing member are located adjacent said surface having said annular recess therein.

6. A multi-stage turbine impeller pump assembly, including in combination:

a rotatable shaft;

inboard and outboard end casing members coupled together, each having cavity channels therein and each having an annular recess therein and an axial opening there through which permits said shaft to rotate therein;

inboard and outboard liner members structurally arranged to be received by the respective annular recesses in said casing members, with each of said liner members being fixed to a respective one of said casing members;

at least two impeller members positioned between said liner members and fixed for rotation with said shaft;

at least a segmented intermediate section comprised of inboard and outboard liner members mounted within a casing ring and keyed to said inboard and outboard casing member, with said intermediate section having at least dual flow channels uniformly distributed therein and having an inlet and a discharge positioned at 180° or less from each other to provide equal and opposing pressures on said impellers; and wherein said inboard and said outboard liner members each have at least dual flow channels which are uniformly distributed therein and include an inlet and a discharge positioned at 180° or less from each other and which are structurally arranged to cooperate with said cavity channels in said inboard and said outboard end casing members to provide equal and opposing pressures on said impeller member to maintain said impeller in alignment with respect to said liner members.

7. The multi-stage turbine impeller pump assembly in accordance with claim 6, wherein said inboard and said outboard liner members each have through flow channels associated therewith and structurally arranged to cooperate with said cavity channels.

8. The multi-stage turbine impeller pump assembly in accordance with claim 6, wherein each of said inboard and said outboard liner members have fixed sealing surfaces having a plurality of recesses thereon disposed in at least one annular and symmetrical pattern, with each of said recesses having a leading edge and a trailing edge to provide a pressurized film of fluid between said sealing surfaces and said rotating impeller.

9. The multi-stage turbine impeller pump assembly in accordance with claim 6, wherein said outboard casing member includes a suction inlet port in the surface of said casing member opposite said surface having said annular recess therein, which port cooperates with said cavity channels therein.

10. The multi-state turbine impeller pump assembly in accordance with claim 7, wherein said cavity channels of said outboard casing member are located adjacent said surface having said annular recess therein.

11. The multi-stage turbine impeller pump assembly in accordance with claim 6, wherein each pumping stage includes an inlet of said pump aligned with an outlet of a preceding pumping stage.

12. The single stage turbine impeller pump assembly in accordance with claim 1, wherein each of said liner member are keyed to a respective casing member and said impeller member is keyed for rotating with said shaft.

13. The multi-stage turbine impeller pump assembly in accordance with claim 6, wherein each of said liner members are keyed to a respective casing member and said impeller members is keyed for rotating with said shaft.

* * * * *

UNITED STATES PATENT AND TRADEMARK OFFICE

CERTIFICATE OF CORRECTION

PATENT NO. : 6,190,119 B1
DATED : February 20, 2001
INVENTOR(S) : Peter P. Roth, Bruce C. Wright, and Paul E. Roth It is certified that error appears in the above-identified patent and that said Letters Patent is hereby corrected as shown below:

Abstract:
Line 3, delete the word "and", first occurrence.

Column 1,
Line 25, delete the word "is" and insert --are--.

Column 2,
Line 46, after the word "structures", insert --,--.

Column 4,
Line 37, delete the word "a" and insert --an--.

Claims:
Column 8,
Line 19, delete the word "multi-state" and insert --multi-stage--;
Line 28, delete the word "member" and insert --members--;
Line 34, delete the word "is" and insert --are--.

Signed and Sealed this

Third Day of July, 2001

Nicholas P. Godici

*Attest:*

*Attesting Officer*

NICHOLAS P. GODICI
*Acting Director of the United States Patent and Trademark Office*